US005579606A

United States Patent [19]

Kim

[11] Patent Number: 5,579,606

[45] Date of Patent: Dec. 3, 1996

[54] REFRIGERATOR DOOR OPENING/CLOSING APPARATUS

[75] Inventor: Yong M. Kim, Suwon, Rep. of Korea

[73] Assignee: Samsung Electronics Co., Ltd., Suwon, Rep. of Korea

[21] Appl. No.: 325,022

[22] Filed: Oct. 18, 1994

[30] Foreign Application Priority Data

Nov. 30, 1993 [KR] Rep. of Korea ..... 1993-25775

[51] Int. Cl.[6] ..... E05F 1/10; E05D 7/00

[52] U.S. Cl. ..... 49/386; 49/388; 49/398; 16/284; 312/405

[58] Field of Search ..... 49/381, 386, 398, 49/388; 16/284, 280, 277, 334, 325; 312/405

[56] References Cited

U.S. PATENT DOCUMENTS

| | | | |
|---|---|---|---|
| 3,388,954 | 6/1968 | Smith | 49/386 |
| 3,996,699 | 12/1976 | Crowe | 49/386 |
| 4,163,344 | 8/1979 | Scherer | 49/386 |
| 5,220,747 | 6/1993 | Cherry et al. | 49/386 |
| 5,271,652 | 12/1993 | Watanabe et al. | 49/386 |

FOREIGN PATENT DOCUMENTS

| | | |
|---|---|---|
| 89-5292 | 4/1989 | Rep. of Korea . |
| 91-11734 | 7/1991 | Rep. of Korea . |

*Primary Examiner*—Kien T. Nguyen
*Attorney, Agent, or Firm*—Burns, Doane, Swecker & Mathis, L.L.P.

[57] ABSTRACT

A refrigerator includes a door hinged to a housing, and a door opening/closing assist device which aids in opening and closing the door. The device includes a spring-biased roller carried by the door and a guide plate carried by the housing. The guide plate forms a guide curvature against which the roller is elastically biased. The guide curvature is shaped so that during an initial stage of a door opening (or closing) movement the roller is displaced by the guide curvature to cause the spring to store energy, and so that during a final stage of the door opening (or closing) movement, the spring releases energy and forces the door to assist the performance of the final stage.

16 Claims, 4 Drawing Sheets

REFRIGERATOR DOOR OPENING/CLOSING APPARATUS

BACKGROUND OF THE INVENTION

This invention relates to a refrigerator door opening/closing apparatus which facilitates the opening and closing of a refrigerator door without effort and by which the door can be closed automatically and tightly.

There are disclosed various refrigerator door opening/closing apparatuses which can close the door tightly to prevent the outflow of cooled air. A typical type, for example, is disclosed in Korean Utility Model Laid Open No. 89-5292.

As shown in FIG. 1, the prior art comprises a hinge member 1 which is fixed to the cabinet 1 of a refrigerator and has a hinge shaft 3 at one end thereof, a fixed member 8 attached to the top of the refrigerator door 4, and an elastic member 5 arranged under the fixed member 8. A round-shaped projection 7 is attached to the cabinet at a distance from the hinge member 2 and an aperture 6 is formed on the elastic member 5 in order to elastically receive or release the projection 7.

By such a structure, when the door 4 is opened, the aperture 6 is expanded to release the projection 7 from the elastic member 5, and on the contrary when the door 4 is closed, the aperture 6 is again expanded to receive the projection 7 into the elastic member 5, thereby closing the door 4 tightly.

However, the door opening/closing apparatus according to the prior art has a disadvantage that the user must pull or push with an effort to open or close the door 4. Especially, the above disadvantage becomes more serious when such a door opening/closing apparatus is mounted on a large-sized refrigerator in which the door is relatively weighty.

As a more improved type, a refrigerator door opening/closing apparatus utilizing the elasticity of a spring is disclosed in Korean Utility Model Laid Open No 91-11734.

FIG. 2A illustrates a door opening/closing apparatus according to such prior art in which the refrigerator door 17 is opened less than 90°. A fixed member 11 on which a movable member 12 and a spring 13 are placed is mounted on a hinge member 10.

The fixed member 11 of a cylindrical shape has a projection 14 of a trapezoid shape.

There is a cut portion 15 on the movable member 12, which is cut in a shape corresponding to the trapezoid-shaped projection 14.

The movable member 12 is rotatably inserted onto the fixed member 11 by a rod 16 which is installed inside the movable member 12.

The members 11, 12, 13 are located in the interior of the door 17 which is shown in a dotted line.

In the closed state of the door 17 (not shown), the cut portion 15 in the member 12 is engaged with the projection 14 on the fixed member 11 and the spring 13 is kept in the stretched state.

When the door 17 is opening (FIG. 2A), the cut portion 15 in the member 12 is moved upwardly along the side surface of the projection 14 on the fixed member 11, the spring 13 being compressed.

As shown in FIG. 2B, when the bottom of the member 12 reaches the top of the projection 14, the door 17 is completely opened with the spring 13 fully compressed.

If in this state the user pushes the door 17 slightly to close it, whereupon the member 12 is slid downward along the side surface of the projection 14 on the fixed member 11 so that the cut portion 15 of the member 12 is fitted over the projection 14 of the fixed member 11. As a result, the door 17 is automatically closed.

However, the above refrigerator door opening/closing apparatus has some disadvantages. That is, the user must apply a relatively great pulling force to the door 17 because the side surfaces of both the projection 14 and the cut portion 15 which guide upward the member 12 on the fixed member 11 form a steep incline.

Further, collision noise between the door 17 and the body of the refrigerator, which will result in damage to the refrigerator, is generated by the apparatus because if the user slightly pushes the opened door 17, the door 17 is rapidly closed by the elasticity of the spring 13.

In addition, the movement of the member 12 on the fixed member 11 is not smooth and noise may be generated from the contact surfaces of both the members 11, 12 because the member 12 slides on the fixed member 11.

An object of this invention is to solve the above problems by providing a refrigerator door opening/closing apparatus by which a refrigerator door can be opened/closed automatically and smoothly.

Another object of this invention is to provide a refrigerator door opening/closing apparatus by which a refrigerator door can be closed tightly to prevent cooled air in the interior of the refrigerator from being discharged.

Still another object of this invention is to provide a refrigerator door opening/closing apparatus by which a refrigerator door can be opened and closed without effort.

SUMMARY OF THE INVENTION

The refrigerator door opening/closing apparatus according to this invention comprises a hinge member fixed to a side of the refrigerator, a guide member which is fixed to the top surface of the hinge member and has guide curves formed along the side surface thereof, a recess formed on the door, a roller which rolls along the guide curves, a support member for rotatably supporting the roller, and an elastic member arranged at the interior of the recess to elastically move the support member.

One end of the supporting member contacts the elastic member and the other end of the supporting member is rotatably connected to the roller.

The support member includes an upper element arranged in the interior of the recess, and a lower element of cylindrical shape extending downward from the center of the upper element.

Further, a cover having an opening for moving the lower element right and left is attached to the recess in which the elastic member and the upper element are arranged.

The guide curves include a semicircular concaved portion for seating the roller on the guide member in the closed state of the door, a first curve for gradually compressing the elastic member until the roller reaches the peak of the guide curves when the door is opened, and a second curve for gradually returning the elastic member to normal until the roller reaches the end of the second curve.

Further, a stopper is provided adjacent to the end of the second curve in order to prevent the roller from further rolling along the guide curves when the door is opened.

When the refrigerator door is fully-closed, the elastic member is in the relaxed state and the roller is seated in the concaved portion of the guide member. If in this state the user opens the door, the roller rolls along the first curve so that the elastic member is compressed by the support member until the roller reaches the peak between the guide curves. If the user stops opening the door before the roller reaches the peak, the refrigerator door is automatically closed by the restoring force of the elastic member.

When the roller goes over the peak with the continuing opening movement of the door, the roller rolls along the second curve by the restoring force of the elastic member until it contacts the stopper, so that the door is automatically opened.

If in order to close the door the user pushes the opened door until the roller goes over the peak between the guide curves, this door opening/ closing apparatus operates in the opposite sequence of the opening movement. That is, the roller rolls along the second curve toward the peak and the elastic member is compressed by the support member. When the roller goes over the peak, the compressed elastic member returns to normal relaxed state so that the roller automatically rolls along the first curve and is positioned in the concaved portion.

As a result, the door is automatically and tightly closed.

As you can understand from the above description, this invention has an advantage that the opening and closing movements of the door are very smooth because the roller rolls along the round guide curves.

Further, this invention has another advantage that the user can open or close the door without effort because if the roller goes over the peak on the guide curves, the door is automatically opened or closed by the elastic force of the elastic member. Therefore, this invention is especially suitable for a large-sized refrigerator in which its door is relatively weighty.

In addition, there is no outflow of cooled air that happens through the opened door due to the user's carelessness because if the roller goes over the peak toward the first curve, the door is closed automatically and tightly by the elastic member.

BRIEF DESCRIPTION OF THE DRAWINGS

In the accompanying drawings:

FIGS. 2A and 2B are perspective views of another prior art refrigerator door opening/closing apparatus, wherein FIG. 2A illustrates the apparatus when the door is slightly opened and FIG. 2B illustrates the apparatus when the door is completely opened;

DESCRIPTION OF THE PREFERRED EMBODIMENT

Figure 1:
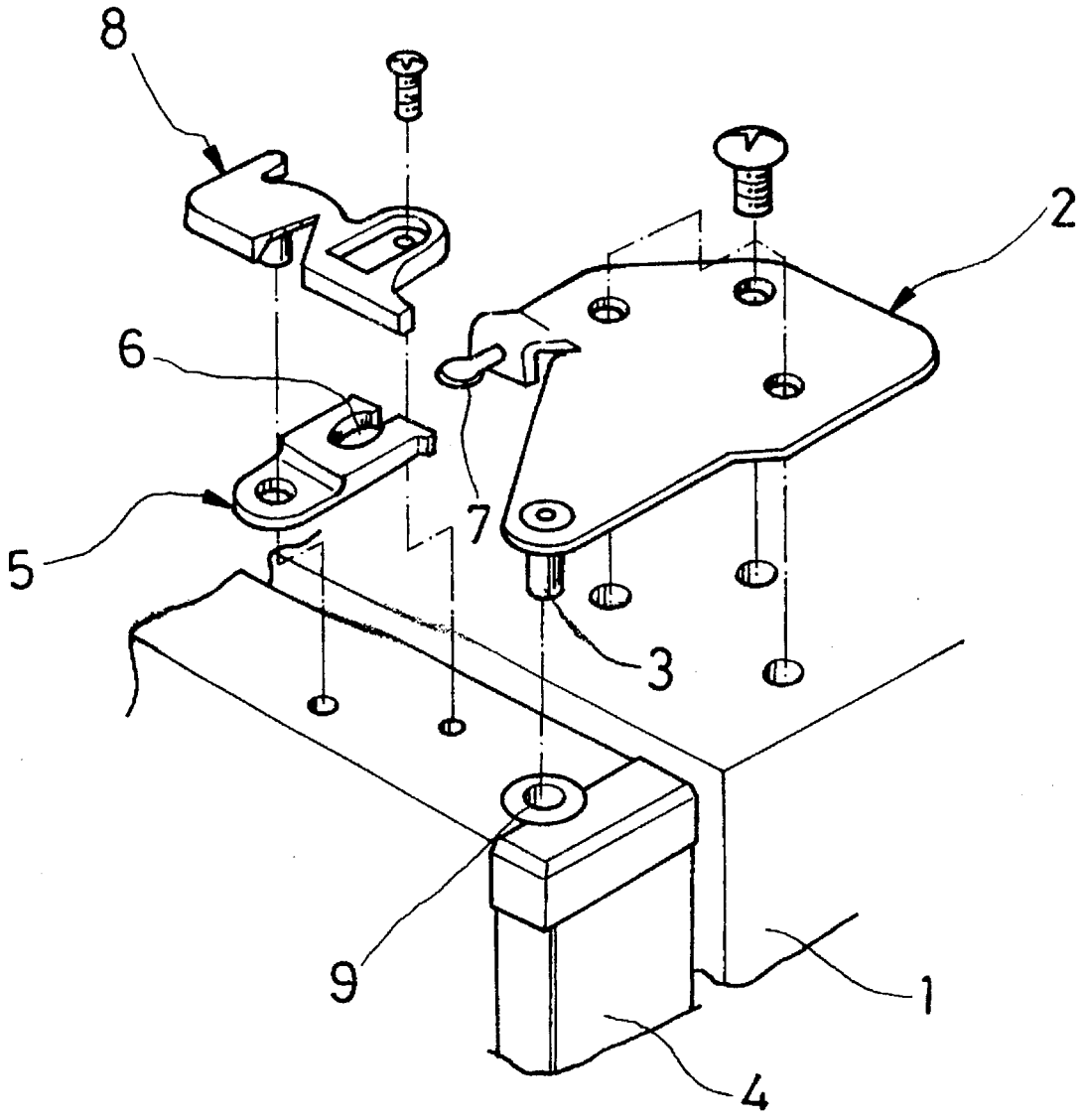
FIG.1 (PRIOR ART)
FIG. 1 is an exploded perspective view of one prior art refrigerator door opening/closing apparatus.
Figure 2A:
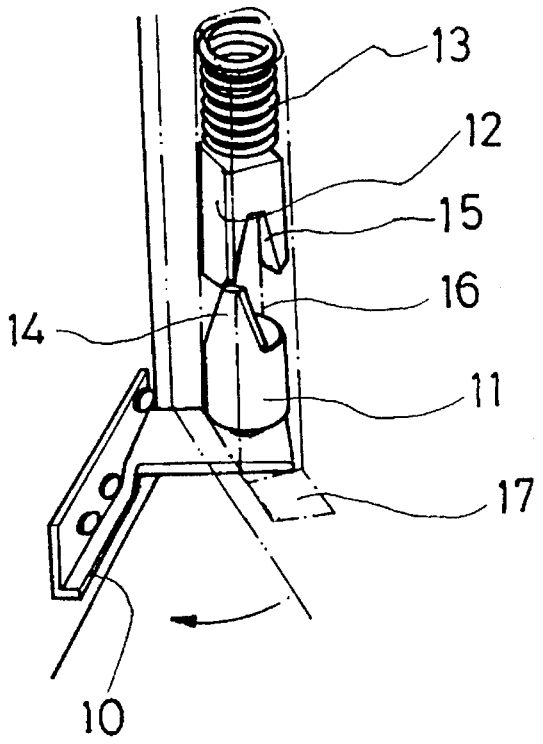
FIG. 2 A (PRIOR ART)
Figure 2B:
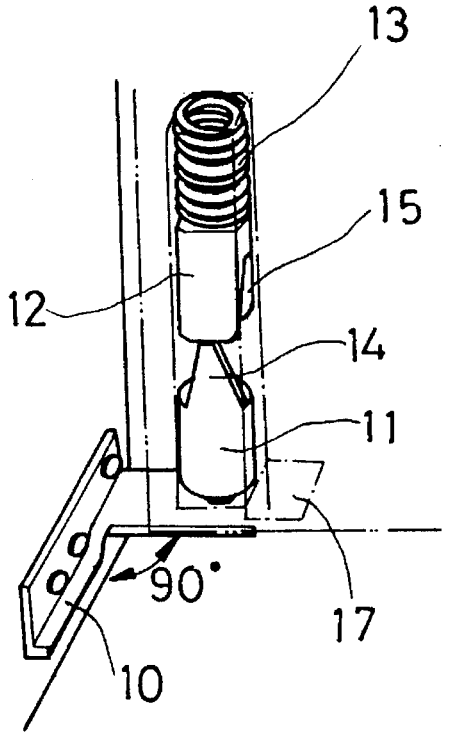
FIG. 2 B (PRIOR ART)

This invention will now be described in detail referring to the drawings.

Figure 3:
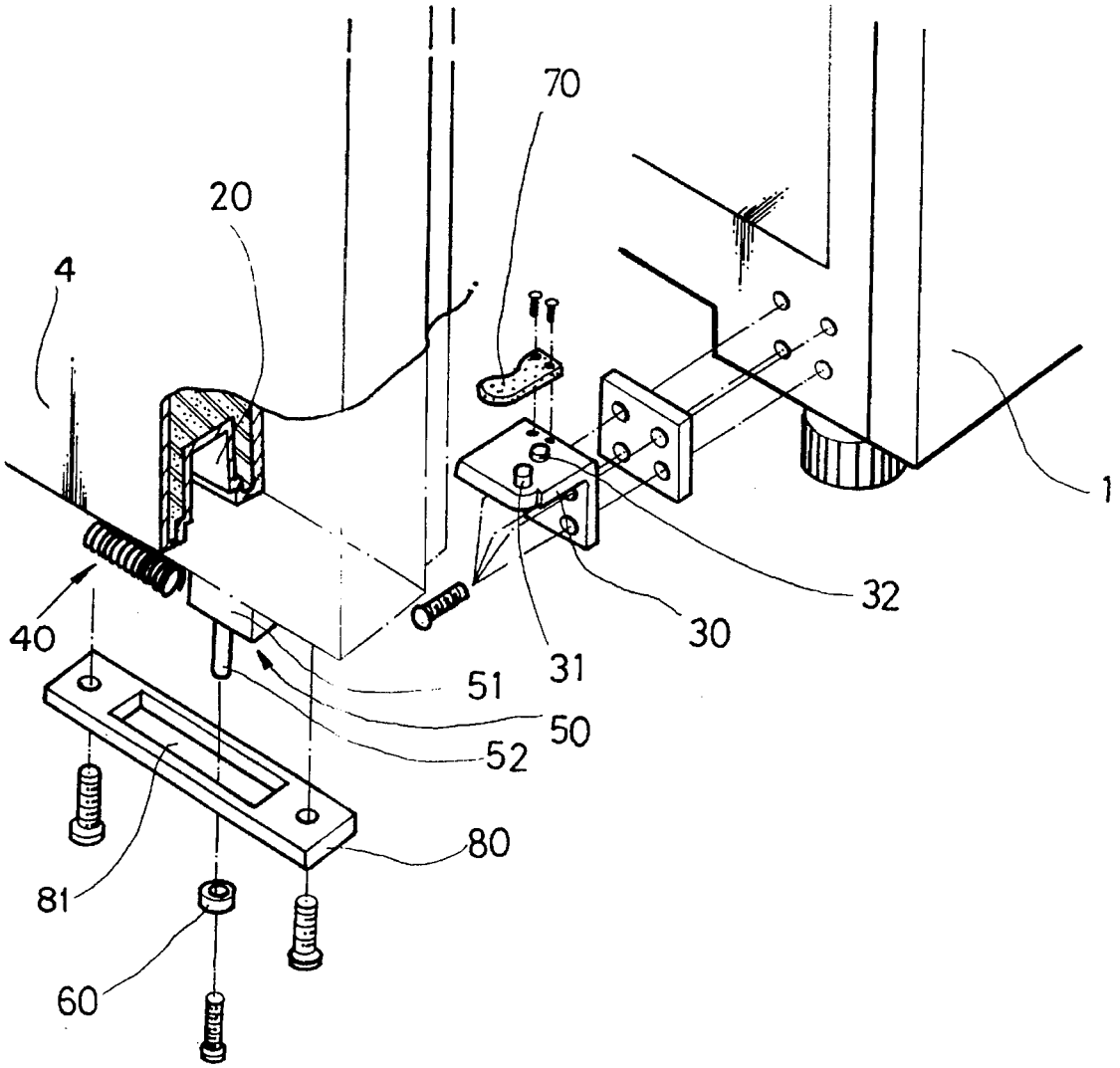
FIG. 3 is an exploded perspective view of the refrigerator door opening/closing apparatus according to this invention.

FIG. 3 shows an exploded perspective view of the refrigerator door opening/closing apparatus according to this invention.

This invention comprises a hinge member 30 fixed to the lower end of the refrigerator cabinet or housing 1, and an elastic member 40 and a support member 50 which are arranged in a recess 20 formed at the bottom of the door 4. A roller 60 is rotatably connected to the lower end of the support member 50. A guide member 70 is fixed to the top surface of the hinge member 30, and a cover 80 is provided for covering the recess 20.

A hinge shaft 31 is inserted into a hinge hole 33 (see FIG. 4) to define a hinge axis for the door 4. A stopper 32 prevents the door 4 from being rotated more than a predetermined angle. Each of members 31 and 32 projects upward from the top surface of the hinge member 30.

Figure 5:
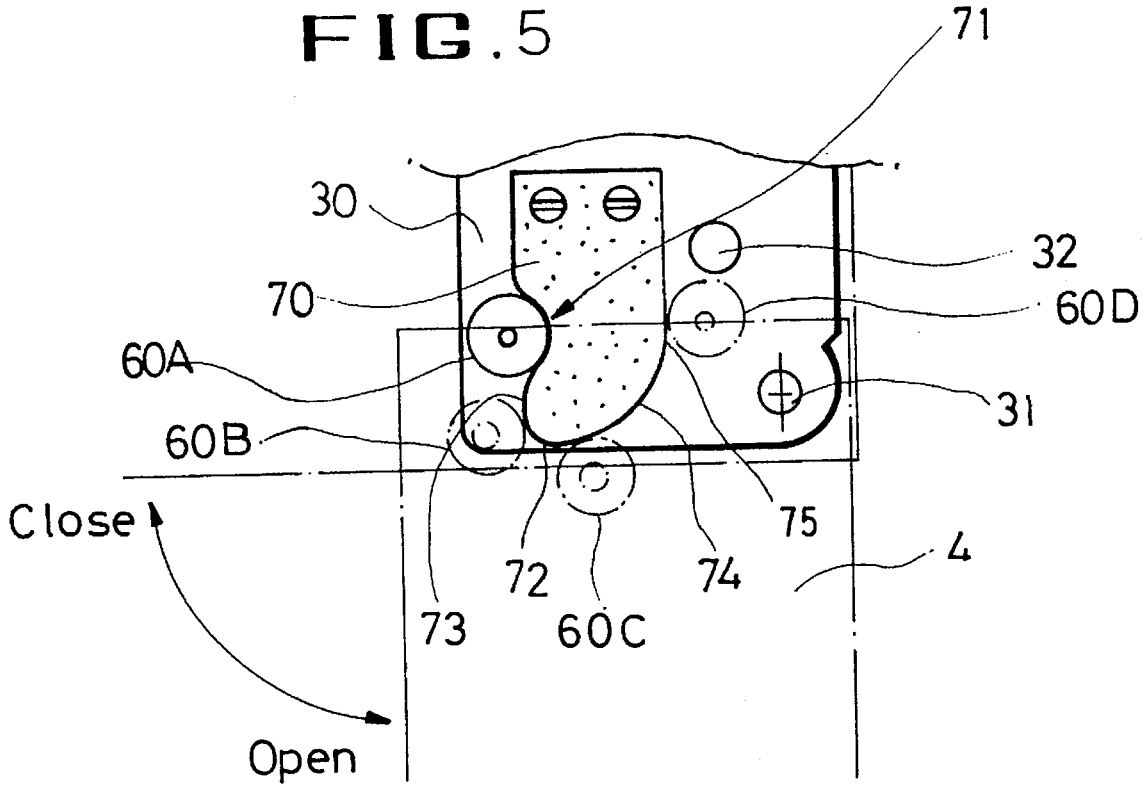
FIG. 5 is a fragmentary sectional view taken along a line V—V shown in FIG. 4.

As shown in FIG. 5, the guide member 70, which is arranged near the stopper 32 has guide curves formed along its side. The guide curves include a semicircular concaved portion 71, a first convex curve 73 extending from the concaved portion 71, a second convex curve 74 extending from the first curve 73, and a peak 72 between the first and second curves 73, 74. The second curve 74 terminates at a point 75 where the movement of the roller 60 is limited by the stopper 32.

Figure 4:
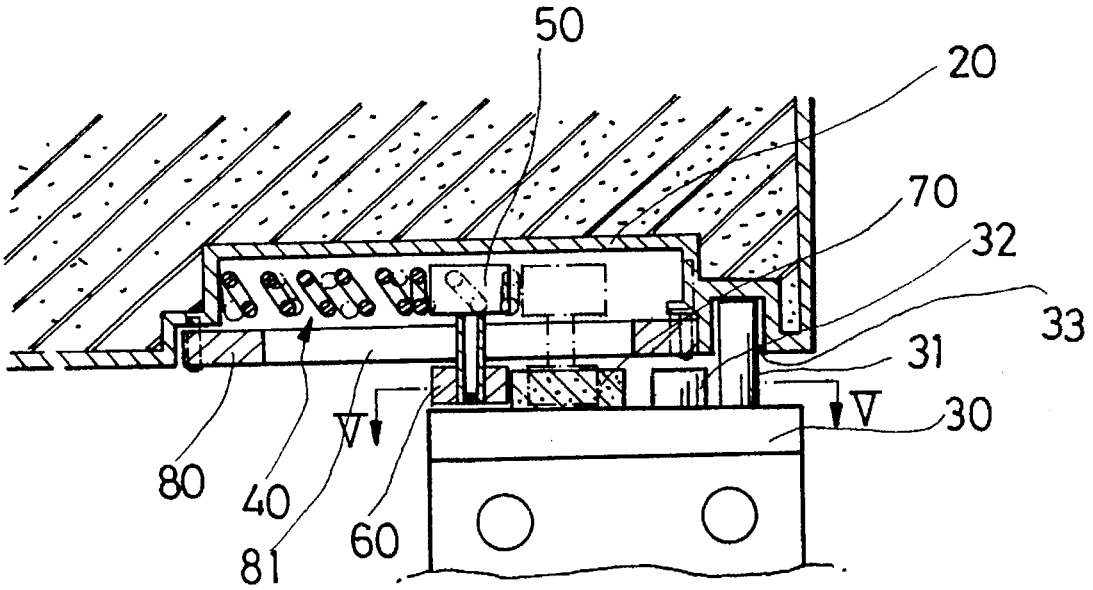
FIG. 4 is a longitudinal sectional view of the refrigerator door opening/closing apparatus according to this invention.

As shown in FIG. 4, the support member 50 comprises an upper element 51, which is arranged in the recess 20, and a cylindrical lower element 52 extending downward from the center of the upper element 51.

The cover 80 has a lengthy opening 81 in order to provide a space for the support member 50 to move right and left.

The elastic member 40 is arranged between one end of the recess 20 and the upper element 51, and the roller is rotatably fitted in the lower element 52. Therefore, the roller 60 is kept in the state of tightly contacting the guide curves on the guide member 70 by means of the elastic member 40.

The operation of the refrigerator door opening/closing apparatus according to this invention will now be described in detail.

As shown in a dotted line in FIG. 4, in the closed state of the door 4, the elastic member 40 is in the state of slightly pressing the support member 50, and so the roller 60 is kept in the state of tightly contacting with the concaved portion 71 of the guide member 70.

In this state, the position of the roller 60 is designated as '60A' in FIG. 5.

As shown in FIG. 5, each corresponding position of the roller 60 on the guide curves for several opening angles of the door 4 is shown in dotted lines.

As mentioned above, when the door 4 is closed, the roller 60 is positioned in the concaved portion 71 of the guide member 70, which position is designated as '60A'. When the door 4 is being opened, the roller 60 rolls along the first curve 73 of the guide member 70 and the elastic member 40 is compressed by the upper element 51 of the support member 50 to store energy. The elastic member 40 continues to be compressed until the roller 60 reaches the peak 72 of the guide member 70, which position is designated as '60B'.

In this state, the refrigerator door 4 is at an angle of about 30°. At this time, if the opening movement of the door 4 is stopped, the roller 60 reversely rolls under the energy-releasing action of the elastic force of the elastic member 40 along the first curve 73 to the concaved portion 71 so that the door 4 is automatically closed.

But if the user continues to open the door 4 so that the roller 60 goes over the peak 72, which is designated as position '60C' in FIG. 5, the elastic member 40 is extended to a relaxed condition by its restoring force, and so the roller 60 is automatically rolled along the second curve 74 by the energy released by the spring and thereby applies a closing force to the door.

Accordingly, even if the user does not apply force to the door 4 any more, the roller 60 is rolled by the restoring force of the elastic member 40 along the second curve 74 of the guide member 70 so that the door 4 is automatically opened.

When the roller 60 reaches the position that is designated as '60D', the elastic force of the elastic member 40 nearly vanishes and further movement of the roller 60 is restricted by the stopper 32.

Accordingly, the door 4 can be completely opened with a smooth movement.

The closing movement of the door 4 is operated in reverse of the aforementioned movements.

If the door 4 is rotated about the hinge shaft 31 to close, the roller 60, which begins from the position designated as '60D', rolls along the second curve 74, and thus the upper element 51 of the support member 50 compresses the elastic member 40. The elastic member 40 continues to be compressed until the roller 60 reaches the peak 72 of the guide member 70.

When the roller 60 goes over the peak 72 and reaches the position '60B' by the continuing movement of the door 4, the roller 60 is caused by the elastic force of the elastic member 40 to roll along the first curve 73 of the guide member 70 and becomes seated in the concaved portion 71, so that the door 4 is closed automatically and tightly.

In brief, this invention automatically opens and closes the refrigerator door 4 with a smooth movement because when the door 4 is rotated about the hinge shaft 31, the roller 60 rolls along the guide curves with the compression and extension of the elastic member 40. Especially, the refrigerator door opening/closing apparatus according to this invention can tightly close door 4 utilizing the elastic force of the elastic member 40.

What is claimed is:

1. A refrigerator comprising:

a stationary housing;

a door hinged to said housing for rotation about an upright axis between open and closed positions; and a door opening/closing assist mechanism, comprising:

a guide member fixed to one of said housing and door and forming a guide curvature, a roller mounted on the other of said housing and door, and an elastic member yieldably biasing said roller toward and against said guide curvature, so that said roller follows said curvature during opening and closing movements of said door, said guide curvature being shaped for displacing said roller in a first direction during an initial stage of said opening and closing movements to cause said elastic member to store energy, and for enabling said roller to be displaced in a second direction during a final stage of said opening and closing movements by released energy from said elastic member to apply a force to said door which assists in the performance of said final stage of movement, said guide curvature including first and second convexly shaped curves defining respective ones of said initial and final stages of each of said opening and closing movements.

2. The refrigerator according to claim 1, wherein said guide member is fixed to said housing, and said roller is mounted on said door.

3. The refrigerator according to claim 1, wherein said elastic member comprises a coil spring.

4. The refrigerator according to claim 1, wherein the elastic member is in a relaxed state when the door is in a fully open state and a fully closed state.

5. A refrigerator comprising:

a stationary housing;

a hinge member fixed to said refrigerator adjacent one side thereof;

a guide member fixed to said hinge member and forming guide curves along an edge thereof;

a door mounted to said hinge member about an upright hinge axis to be rotatable about said axis between open and closed positions, said door including a recess formed therein;

an elastic member mounted in said recess, a roller support engaging said elastic member;

a roller mounted on said roller support for movement therewith and biased toward and against said guide curvature by said elastic member so that said roller follows said guide curvature during opening and closing movements of said door, said guide curvature being shaped for displacing said roller in a first direction during an initial stage of said opening and closing movements to cause said elastic member to store energy, and for enabling said roller to be displaced in a second direction during a final stage of said opening and closing movements by released energy from said elastic member to apply a force to said door which assists in the performance of said final stage of movement.

6. The refrigerator according to claim 5, wherein said support member includes a first portion mounted for reciprocable movement in said recess and being engaged by said elastic member, and a second portion in the form of a pin on which said roller is mounted.

7. The refrigerator according to claim 6, wherein said hinge member is disposed at a lower end of said housing, and said recess is formed in a lower end of said door.

8. The refrigerator according to claim 7, further including a cover extending across said recess and having an elongated opening through which said pin projects.

9. The refrigerator according to claim 5, wherein said guide curvature includes a first curve defining an initial stage of said opening movement and a final stage of said closing movement, and a second curve defining an initial stage of said closing movement and a final stage of said opening movement.

10. The refrigerator according to claim 9, wherein said each of said first and second curves is of convex shape.

11. The refrigerator according to claim 10, wherein said guide curvature includes a concave curve for retaining said roller when said door is in a closed state, said first curve including a first end joined to said second curve, and a second end joined to said concave curve.

12. The refrigerator according to claim 5, further including a stopper disposed adjacent an end of said second curve for being engaged by said roller when said door is in a fully open state.

13. The refrigerator door according to claim 5, wherein said elastic member comprises a coil spring which is compressible to store energy.

14. The refrigerator according to claim 5, wherein said elastic member is in a relaxed state when the door is in a fully open state and a fully closed state.

15. A refrigerator comprising:

a stationary housing;

a door hinged to said housing for rotation about an upright axis between open and closed positions; and a door opening/closing assist mechanism, comprising:

a guide member fixed to one of said housing and door and forming a guide curvature, a roller mounted on the other of said housing and door, and an elastic member yieldably biasing said roller toward and against said guide curvature, so that said roller follows said curvature during opening and closing movements of said door, said guide curvature being shaped for displacing said roller in a first direction during an initial stage of said opening and closing movements to cause said elastic member to store energy, and for enabling said roller to be displaced in a second direction during a final stage of said opening and closing movements by released energy from said elastic member to apply a force to said door which assists in the performance of said final stage of movement, said guide curvature comprising a first curve defining an initial stage of said opening movement and a final stage of said closing movement, and a second curve defining an initial stage of said closing movement and an initial stage of said opening movement.

16. The refrigerator according to claim 15, wherein each of said first and second curves is convexly shaped.

* * * * *